US006962177B1

(12) United States Patent
McCommons

(10) Patent No.: US 6,962,177 B1
(45) Date of Patent: Nov. 8, 2005

(54) LOCKING FUEL PUMP DISPENSER

(76) Inventor: James A. McCommons, 1618 Montecito Ave., Deltona, FL (US) 32738

( * ) Notice: Subject to any disclaimer, the term of this patent is extended or adjusted under 35 U.S.C. 154(b) by 100 days.

(21) Appl. No.: 10/899,723

(22) Filed: Jul. 27, 2004

(51) Int. Cl.[7] ..... B65B 1/04
(52) U.S. Cl. ..... 141/392; 141/383; 220/86.2
(58) Field of Search ..... 141/392, 206–226, 141/59, 383–386; 220/86.2

(56) References Cited

U.S. PATENT DOCUMENTS

| | | | |
|---|---|---|---|
| 4,109,686 | A | 8/1978 | Phillips |
| 4,367,827 | A | 1/1983 | Keller et al. |
| 4,469,149 | A | 9/1984 | Walkey et al. |
| 4,907,630 | A | 3/1990 | Kulikowski et al. |
| 5,156,198 | A | 10/1992 | Hall |
| 5,720,327 | A | 2/1998 | Foster, Jr. |
| 5,727,608 | A | 3/1998 | Nusbaumer et al. |
| 5,729,002 | A | 3/1998 | Samples |
| 5,857,501 | A | 1/1999 | Kelerich et al. |
| 5,918,766 | A | 7/1999 | Osborne |
| 6,157,871 | A | 12/2000 | Terranova |
| 6,334,474 | B1 | 1/2002 | Rababy et al. |
| 6,675,841 | B2 * | 1/2004 | Burns ..... 141/59 |

* cited by examiner

*Primary Examiner*—Steven Douglas
(74) *Attorney, Agent, or Firm*—William M. Hobby, III

(57) ABSTRACT

A locking fuel pump dispenser nozzle has a valved nozzle connected to a pressurized fuel supply and has an elongated spout for insertion into a vehicle filler tube of the type having an annular raised surface therein. The nozzle has a manually actuating valve for controlling the flow of fuel from the pressurized fuel supply through the nozzle into the vehicle filler tube and vehicle fuel tank. The improvement includes a locking mechanism for locking the nozzle spout in the filler tube when filling a vehicle fuel tank.

15 Claims, 2 Drawing Sheets

LOCKING FUEL PUMP DISPENSER

BACKGROUND OF THE INVENTION

The present invention relates to a locking fuel pump fuel dispenser nozzle apparatus and especially to a locking fuel pump fuel dispenser nozzle having a locking mechanism for automatically locking the fuel nozzle spout in the vehicle filler tube whenever fuel is being pumped into the vehicle filler tube and fuel tank.

The refueling of vehicles usually employs a supply hose having a nozzle with a manually operated valve nozzle having a spout insertable into the vehicle fuel tank inlet or filler tube. The nozzle valve is manually operated by a handle and a tube within the spout senses the rising fuel within the inlet neck and automatically closes the nozzle valve upon sensing the presence of the fuel level to thereby prevent overflow and spillage. One problem has been for self-service stations in which patrons provide fuel for their vehicle and then leave without paying for the fuel. The present invention is directed towards locking of the nozzle spout into the vehicle filler tube until released by the station operator remotely upon payment being made for the supplied fuel.

The prior art U.S. patents relating to the fueling of vehicles include the Kulikowski et al. U.S. Pat. No. 4,907,630 for an automatic shut-off and self-locking refueling nozzle. This refueling nozzle has means for attaching the nozzle to the vehicle tank inlet neck and inlet port and provides for automatic shut-off of the refueling nozzle. In one embodiment, a secondary control valve prevents fluid flow until the nozzle has been fully connected to the inlet tank. The Phillips U.S. Pat. No. 4,109,686 is a tax adjusting vehicle gasoline filler apparatus which suggests a locking system for the fuel nozzle which is released only by proper engagement with a receiver and connects the fuel nozzle to the filler neck with a bayonet type connection. The customer twists the nozzle after insertion into the filler neck of the gasoline tank passing the lugs against the stop provided in grooves. The Keller U.S. Pat. No. 4,367,827 is for an anti-theft mechanism for a gasoline pump and is designed to prevent drive-off by having a patron place his ignition key into a switch mechanism which automatically clamps and maintains the key until the key is released by operation of a remote switch. The Walkey et al. U.S. Pat. No. 4,469,149 is for a monitored delivery system which provides on the fuel nozzle an optical bar code reader for reading a bar code for determining whether a given vehicle is authorized to receive fuel. The Hall U.S. Pat. No. 5,156,198 is for a pump lock fuel system which provides a communication link between a vehicle and a fuel distribution system prior to pumping fuel to the vehicle. The Foster, Jr. U.S. Pat. No. 5,720,327 is for a vehicle safety fueling system for preventing accidental drive-off of the vehicle from a fuel pump without first removing a fuel dispensing nozzle. The Nusbaumer et al. U.S. Pat. No. 5,727,608 is for an automated fuel management system. A fuel dispenser station has a fuel dispensing nozzle adapted for mating with and being secured to a fuel receiving tank. The Sample U.S. Pat. No. 5,729,002 is for an electronic bar coded gasoline scanner. A bar code is imprinted within a top portion of a gasoline tank fill pipe and a laser scanner is secured to the gasoline dispensing nozzle. The Kelerich et al. U.S. Pat. No. 5,857,501 is a fueling system identification system having an inductive communication loop arranged to surround a fuel intake pathway of a vehicle for reading and transmitting the vehicle identification number, credit information and the like. The Osborne U.S. Pat. No. 5,918,766 is a locking forecourt fuel pump for locking a delivery nozzle in the pump. The Terranova U.S. Pat. No. 6,157,871 is for a fuel dispensing system for preventing customer drive-off and provides a control system for detecting where the drive-off has taken place and using this signal to cause a remote communication to take measure to prevent future transactions involving that customer. The Rababy et al. U.S. Pat. No. 6,334,474 is a breakaway separation detection and alert system for preventing and minimizing damage caused by breakaway separation in the fuel lines supplying the fuel nozzle. The present invention in contrast is a locking fuel pump fuel dispenser nozzle which locks the spout of the fuel pump nozzle into the vehicle filler tube automatically when a patron starts to deliver fuel to the vehicle. The nozzle spout remains locked to the vehicle filler tube until released remotely by a station operator and therefore is directed towards preventing fuel theft by preventing drive-off of the patron filling the tank at a self-service station.

SUMMARY OF THE INVENTION

A locking fuel pump dispenser nozzle has a valved nozzle connected to a pressurized fuel supply and has an elongated spout for insertion into a vehicle filler tube of the type having an annular raised surface therein. The nozzle has a manually actuating valve for controlling the flow of fuel from the pressurized fuel supply through the nozzle into the vehicle filler tube and vehicle fuel tank. The improvement includes a locking mechanism for locking the nozzle spout in the filler tube when filling a vehicle fuel tank. The locking mechanism has a pair of radially extending locking wedges adapted to extend from an unlocked position to an extended locked position upon the presence of fuel pressure in the nozzle valve and associated diaphragm. A locking wedge activating diaphragm is mounted in the nozzle and coupled to the locking wedge to move the locking wedge from an unlocked to a locked position upon fluid pressure being applied to the diaphragm. Means are provided for holding the wedge in a locked position until released whenever the fuel is being pumped into the vehicle fuel tank filler tube. The locking mechanism includes a racheting mechanism activated by the diaphragm for rotating a locking member locking slide between slots of different depths for holding a pair of arms above the locking wedges in a locked extended position or in an unlocked retracted position.

BRIEF DESCRIPTION OF THE DRAWINGS

Other objects, features, and advantages of the present invention will be apparent from the written description and the drawings in which.

DESCRIPTION OF THE PREFERRED EMBODIMENT

The present invention is for a locking fuel pump fuel dispenser nozzle having a locking mechanism for automatically locking the fuel nozzle spout in the vehicle filler tube whenever fuel is pumped into the vehicle filler tube and fuel tank to thereby prevent removal of the nozzle spout from the filler tube until released remotely by a station attendant.

Figures 1, 3:
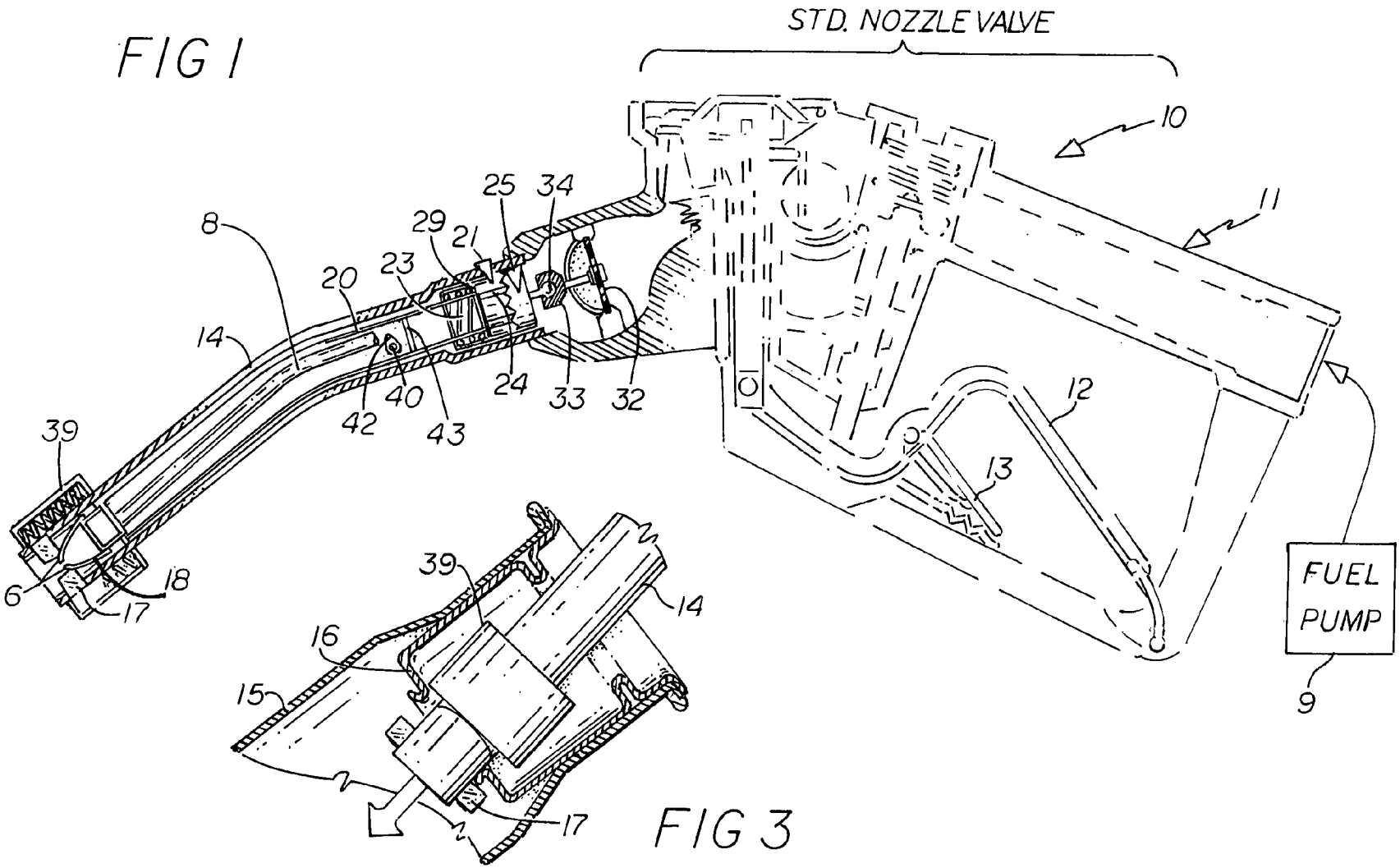
FIG. 1 is a section view of a fuel nozzle having the locking mechanism of the present invention.
FIG. 3 is an exploded view of a locking fuel pump fuel dispenser nozzle in accordance with the present invention.

In FIGS. 1–4 of the drawings, a gas station fuel pump 9 has the fuel pump fuel dispenser hose and nozzle 10 having a standard nozzle valve 11 actuated by a handle 12 having a filling handle lock 13. The nozzle valve has a protruding spout 14 which is inserted into a fuel tank filler tube for a vehicle. In accordance with the present invention, when the spout 14 is inserted into a filler tube 15, as shown in FIG. 3, and passes through the restricted inlet opening 16, a pair of locking wedges 17 are automatically extended from the end of the spout when fuel pressure is present in the nozzle valve upon the fuel pump being turned on. The locking wedges 17 will extend to lock the spout 14 into the filler tube 15 even after fuel dispensing ceases and until the locking wedges 17 are released. Locking wedges 17 can be released remotely as hereinafter described.

Figure 2:
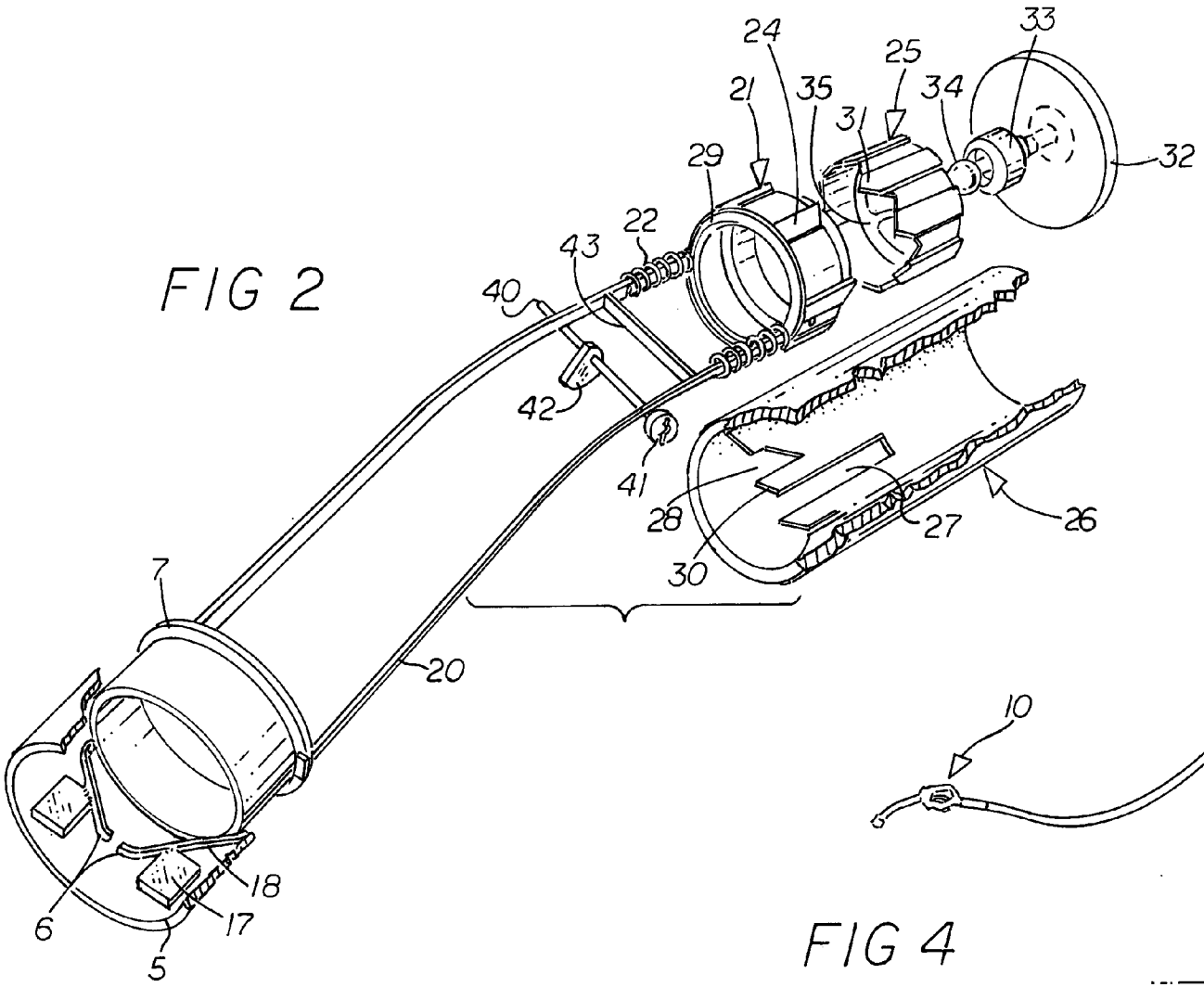
FIG. 2 is a sectional view of a vehicle filler tube having a locking nozzle attached thereto.
Figure 4:
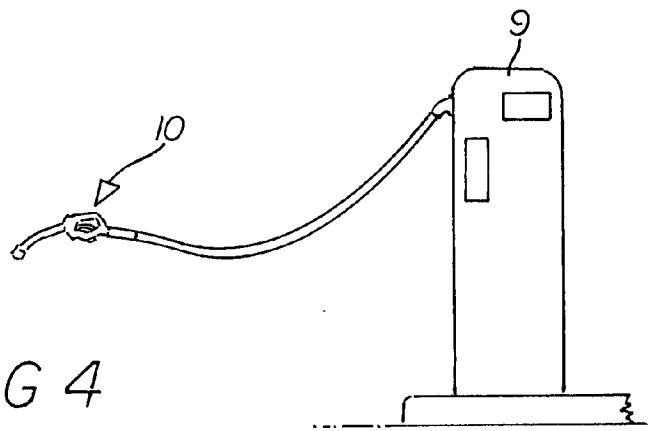
FIG. 4 is a diagrammatic view of a fuel pump and fuel nozzle.

The locking wedges 17 are attached to a pair of locking wedge springs 18 which in turn are attached to a pressed in sleeve 5. A pair of connecting arms 20 are connected to an inner sleeve 7. Moving the connecting arms 20 back and forth within the nozzle 10 spout 14, extends or retracts the locking wedges 17 via the inner sleeve 7. The arms 20 are attached to a ring 29 which rides against the rotating locking member 21 which is also the bottom racheting member. The arms 20 are attached through tensioning springs 22, as seen in FIG. 2, but the rotating lock 21 is spring biased by a spring 23 which rides against ring 29 in a rearward direction so as to bias the arms 20 to hold the locking wedge members 17 in their retracted and unlocked position in a normal state. The rotating lock 21 has at least one locking slide 24 thereon.

The racheting locking mechanism for the present invention is made up of a racheting member 25, the rotating lock 21 and the locking sleeve 26 which, in FIG. 2, fits over the racheting member 25 and locking member 21. The locking sleeve has alternate long slots 27 alternating with short slots 28. Each slot may have an angled edge 30 for assisting the rotating lock 24 slide into the long or short slots 27 or 28. The racheting member 25 has a continuous annular set of pointed teeth 31. The entire locking mechanism can be seen in FIG. 1 which fits entirely within the standard nozzle valve spout and has a diaphragm 32 connected to a socket 33 which in turn is connected to a ball 34 which is attached to the upper racheting member 31 with a plurality of arms 35.

In operation, when the fuel pump is turned on, a fluid pressure is applied to the diaphragm 32 which in turn drives the socket 33 and ball 34 to push the ratchet member 31 forward with the teeth 31 engaging the locking slides 24 and pushing the rotating lock 21 and arms 20 forward against the coil spring pressure of coil 23 and thereby pushing the inner sleeve 7 against the locking wedge springs 18 to move the locking wedges into a locking position where they will stay until fuel pressure is again present against the diaphragm 32. However, when the teeth 31 push against the locking slots 24, because of their angled surfaces, they will force the locking slide to rotate. The locking slides 24 is normally in rest position in the unlocked position of slot 27. That is, the locking slide 24 is in a long slot 27 with the locking wedges in an unlocked position. The sleeve 26 extends over the racheting member 25 and the rotating lock 21 but with the locking slide members 24 extending above and into slots 27 or 28. The rotating lock 21 cannot rotate as long as the slides 24 are in either the slot 27 or 28 until the ratchet member 25 drives the rotating lock 21 forward when fuel pressure is applied to the diaphragm 32. This then forces the slide 24 to rotate since it is riding against the angle of one of the teeth 31 which rotates it slightly and along with the angled surfaces 30 adjacent the slots 27 and 28, the locking slide 24 will rotate to the next adjacent slot such as rotating from a long slot to a short slot and then back to a long slot. Thus, when the fuel pressure is released from the diaphragm 32, the racheting member 25 withdraws and allows the rotating locking member 21 to slide backward. The locking slide 24 has been rotated from a long slot 27 to a short slot 28 which prevents the rotating lock 21 and attached arms to retract far enough to retract the locking wedges 17 to an unlocked position. However, applying a momentary pressure, like activating the fuel pump for a penny's worth of gas, by a remote gas station attendant will momentarily push the diaphragm and the ratchet member 25 forward to push the rotating lock 21 forward while rotating the locking slide 24 to the next slot which will be the unlocked position. Since the pressure is immediately released, the wedges are unlocked by the slide 24 sliding into the long slot or unlocked position which retracts the arms through the pressure from the coil spring 23 to retract the locking wedge springs and locking wedge members 17.

An emergency release is provided with a rotating shaft 40 located adjacent the arms 20 and having a key end 41 for inserting a special key for rotating the shaft 40. The shaft 40 has a cam member 42 attached thereto so that rotating the shaft 40 rotates the cam and rotates the cam against a camming bar 43 attached between the arms 20 to thereby push the arms backwards against the coil spring 23 to pull the locking wedges 17 into an unlocked position.

In operation, the standard fuel nozzle spout 14 is removed from a gas station fuel pump 9 and inserted into a vehicle filler tube 15 until it passes the restrictor area 16 thereby moving the outer sleeve 39 upward where the patron begins to pump gas by pulling on the handle 12. The upward movement of the outer sleeve 39 exposes and immediately extends the locking wedges 17 as long as there is pressure on the diaphragm 32 driving the arms 20 forward by pressure being applied to the racheting member 25 and rotating locking member 21. However, in pushing the arms 20 forward with the racheting member, it forces the locking member 21 to rotate slightly by sliding on the angled surfaces of the teeth 31 once the locking slides are pushed forward enough to be removed from slot 27 to slot 28. Thus, when pressure is released on the diaphragm 32, the racheting member 25 retracts allowing the locking member 21 to slide backwards with the locking slide 24 falling into the adjacent locked position or short slot 28 and holding the arms 20 extended against the pressure of the coil spring 23 and thus leaving the locking wedges extended and locking the filler spout 14 in the filler tube 15 so that a patron cannot leave without paying for the dispensed gas. The station attendant can quickly and remotely unlock the filler spout 20 from the filler tube 15 by applying a brief and momentary pressure to the diaphragm 32 to force the rotation of the locking slides from the locking slot 28 into the unlocking slot 27.

It should be clear at this time that a locking fuel pump fuel dispenser nozzle has been provided which has a locking mechanism for automatically locking the fuel nozzle spout in the vehicle filler tube whenever fuel is being pumped into the vehicle filler tube and fuel tank and leaving the nozzle spout locked into the filler tube until released by an attendant. Another feature of this device is that if someone attempts to defeat the locking mechanism by inserting the nozzle pipe 14 just slightly into the filler tube 15, but not sufficient to allow the outer sleeve 39 to fully expose and extend the locking wedges outward while past the restrictor area 16, the curved extensions 6 attached to the locking wedge springs 18 will be in the center of the fuel stream and redirect a sufficient amount of the fuel rearward into the auto-shutoff tube 8 (FIG. 1) automatically closing the nozzle valve. This will continue to occur until the patron gives up and pushes the nozzle pipe 14 further into the filler tube 15 and past the restrictor area 16 thereby allowing the locking wedges 17 to extend into their locked position and moving the curved extensions 6 out of the main fuel stream. This action virtually eliminates any refueling prior to the locking wedges 17 being released past the restrictor area 16. However, the present invention is not to be construed as limited to the forms shown which are to be considered illustrative rather than restrictive.

I claim:

1. A locking fuel pump fuel dispenser nozzle having:

a nozzle connected to a fuel pump and having an elongated spout for insertion into a vehicle filler tube having an annular raised surface therein, said nozzle having a manually actuating valve for controlling the flow of fuel from said fuel pump through said nozzle into said vehicle filler tube, the improvement comprising:

a locking mechanism for locking said nozzle spout in said filler tube when filling a vehicle fuel tank, said locking mechanism having at least one locking wedge adapted to extend between an unlocked position and a locked position and a locking wedge activating diaphragm mounted in said nozzle and coupled to said locking wedge to move said locking wedge from an unlocked to a locked position upon fluid pressure being applied thereto and means for holding said wedge in a locked position when fuel flow is cut off until released whereby a fuel dispenser nozzle spout locks into a filler tube whenever fuel is flowing through said nozzle into said vehicle filler tube and fuel tank and immediately after the fuel flow ceases.

2. The locking fuel pump fuel dispenser nozzle in accordance with claim 1 in which said locking wedge is released from a locked position by the application and release of fuel pressure to said Diaphragm.

3. The locking fuel pump fuel dispenser nozzle in accordance with claim 2 in which there are a plurality of locking wedges activated simultaneously by the movement of said diaphragm.

4. The locking fuel pump fuel dispenser nozzle in accordance with claim 3 including at least one arm coupled between said diaphragm and each said locking wedge for movement of said locking wedge between locked and unlocked positions.

5. The locking fuel pump fuel dispenser nozzle in accordance with claim 4 having a plurality of arms coupled between said diaphragm and said plurality of locking wedges.

6. The locking fuel pump fuel dispenser nozzle in accordance with claim 5 including a ratchet mechanism having a ratchet member and a locking ring having at least one locking slide member thereon, said ratchet member being coupled to said diaphragm for rotating said locking member when said ratchet member is moved thereagainst by said diaphragm.

7. The locking fuel pump fuel dispenser nozzle in accordance with claim 6 in which said ratchet mechanism has an annular locking sleeve having a plurality of slots of alternating depths thereon for receiving said locking member locking slide member therein.

8. The locking fuel pump fuel dispenser nozzle in accordance with claim 7 having a coil spring biasing said plurality of arms to hold said plurality of locking wedges in a locked position.

9. The locking fuel pump fuel dispenser nozzle in accordance with claim 8 having a ball coupling between said diaphragm and one of said ratchet member.

10. The locking fuel pump fuel dispenser nozzle in accordance with claim 9 in which each locking wedge is attached to said locking ring through an arm spring.

11. The locking fuel pump fuel dispenser nozzle in accordance with claim 10 in which said ratchet member has a plurality of angled teeth and is coupled to said diaphragm for engaging one said locking member slide when fuel pressure is applied to said diaphragm to rotate said locking member to an adjacent locking sleeve locking slot.

12. The locking fuel pump fuel dispenser nozzle in accordance with claim 11 in which said ratchet member teeth push against one said locking member locking slide to moving said locking member slice into alignment between locked or unlocked slots therein, to thereby hold said plurality of wedges extended in a locked position or in a retracted unlocked position in the absence of fuel pressure on said diaphragm.

13. The locking fuel pump fuel dispenser nozzle in accordance with claim 12 having a manual release for releasing said plurality locking wedges.

14. The locking fuel pump fuel dispenser nozzle in accordance with claim 13 in which said manual release includes a cam manually rotated to move said plurality of arms to an unlocked position for releasing said fuel nozzle spout from said filler tube.

15. A locking fuel pump fuel dispenser nozzle having:

a nozzle having an elongated spout for insertion into a vehicle filler tube having an annular raised surface therein, said nozzle having a manually actuating valve for controlling the flow of fuel into said vehicle filler tube and fuel tank, the improvement comprising:

a locking mechanism for locking said nozzle spout in said filler tube when filling a vehicle fuel tank, said locking mechanism having at least one radially extending locking wedge adapted to extend from an unlocked position to an extended locked position and a locking wedge activating diaphragm mounted in said nozzle and coupled to said locking wedge to move said wedge from an unlocked to a locked position upon fluid pressure being applied thereto; and ratchet means having a ratchet wheel coupled to said diaphragm for rotating a locking wheel having a locking slide thereon to cause said locking slide to alternately engage a slotted locking sleeve locked or unlocked slot whenever fuel is applied to said diaphragm to thereby position said locking wheel and said locking wedges in a locked position when said fuel pressure is released from said diaphragm whereby a fuel dispenser nozzle spout locks into a vehicle filler tube whenever fuel is being pumped into said vehicle filler tube and fuel tank by applying fluid pressure to said diaphragm in said nozzle and remains locked in said filler tube upon completion of fueling.

* * * * *